United States Patent [19]

Weedon

[11] 4,163,947

[45] Aug. 7, 1979

[54] CURRENT AND VOLTAGE AUTOZEROING INTEGRATOR

[75] Inventor: Hans J. Weedon, Salem, Mass.

[73] Assignee: Analogic Corporation, Wakefield, Mass.

[21] Appl. No.: 835,967

[22] Filed: Sep. 23, 1977

[51] Int. Cl.[2] ..... G06G 7/18

[52] U.S. Cl. ..... 328/128; 307/229; 328/162

[58] Field of Search ..... 307/229; 328/127, 128, 328/162, 163, 165; 330/9

[56] References Cited

U.S. PATENT DOCUMENTS 3,660,769 5/1972 Jordan et al. ..... 328/127

*Primary Examiner*—John Zazworsky

*Attorney, Agent, or Firm*—Weingarten, Maxham & Schurgin

[57] ABSTRACT

An autozeroing integrating circuit which compensates for input offset voltages and input current to the integrator differential amplifier. During an integrate period, an input signal is integrated in the conventional manner, and a voltage is accumulated on the integrating capacitor. The integrator may be reset to discharge the integrator capacitor in preparation for a new integration. During reset mode, the integrator automatically corrects for input offset voltage errors in the amplifier by storing the offset voltage. During an autozero mode, a charge is stored on a capacitor which provides via a buffer amplifier a current which compensates for the current flowing into the input of the integrator.

11 Claims, 5 Drawing Figures

CURRENT AND VOLTAGE AUTOZEROING INTEGRATOR

FIELD OF THE INVENTION

This invention relates to integrating amplifiers and more particularly to integrators having circuitry for correcting for input current and offset voltage and drifts thereof.

BACKGROUND OF THE INVENTION

Integrating circuits are frequently used building blocks in electronic systems. Such circuits receive an input signal and produce an output which is proportional to the integral over time of this input signal. Typically, an integrator is implemented by means of an operational amplifier having a differential input with capacitive feedback from the output thereof to the inverting input. In applications where great precision is required of the integrator, errors in the differential amplifier and associated circuitry may cause undesirable errors in the output signal from the integrator, such sources of errors including input offset voltages and input currents of the differential amplifier. While these errors may be manually eliminated by means of trimming potentiometers or other devices, these errors are typically dependent on temperature and other circuit parameters. In addition, the magnitudes of these errors tend to change with time. Therefore, circuitry which automatically corrects for these errors is desirable.

SUMMARY OF THE INVENTION

The present invention includes an autozeroing integrating circuit which compensates for input offset voltages and input current to the integrator differential amplifier. During an integrate period, an input signal is integrated in the conventional manner, and a voltage is accumulated on the integrating capacitor. The integrator may be reset to discharge the integrator capacitor in preparation for a new integration. During reset mode, the integrator automatically corrects for input offset voltage errors in the amplifier by storing a voltage on the integrating capacitor equal to the offset voltage. This causes the integrator to begin each integrating period with its output exactly equal to zero.

During an autozero mode, the circuit measures the current flowing into the input of the integrator. In response to this measured input current, a charge is stored on a capacitor which provides via a buffer amplifier a current equal in magnitude but opposite in polarity to the input current to the integrator. This current from the buffer amplifier cancels and compensates for the current flowing into the input of the integrator and prevents the integrator from drifting due to this current.

DESCRIPTION OF THE DRAWINGS

These and other advantages of the invention will become more clear upon reading the following detailed description of the invention and with reference to the following figures, in which.

DETAILED DESCRIPTION OF THE INVENTION

Figure 1:
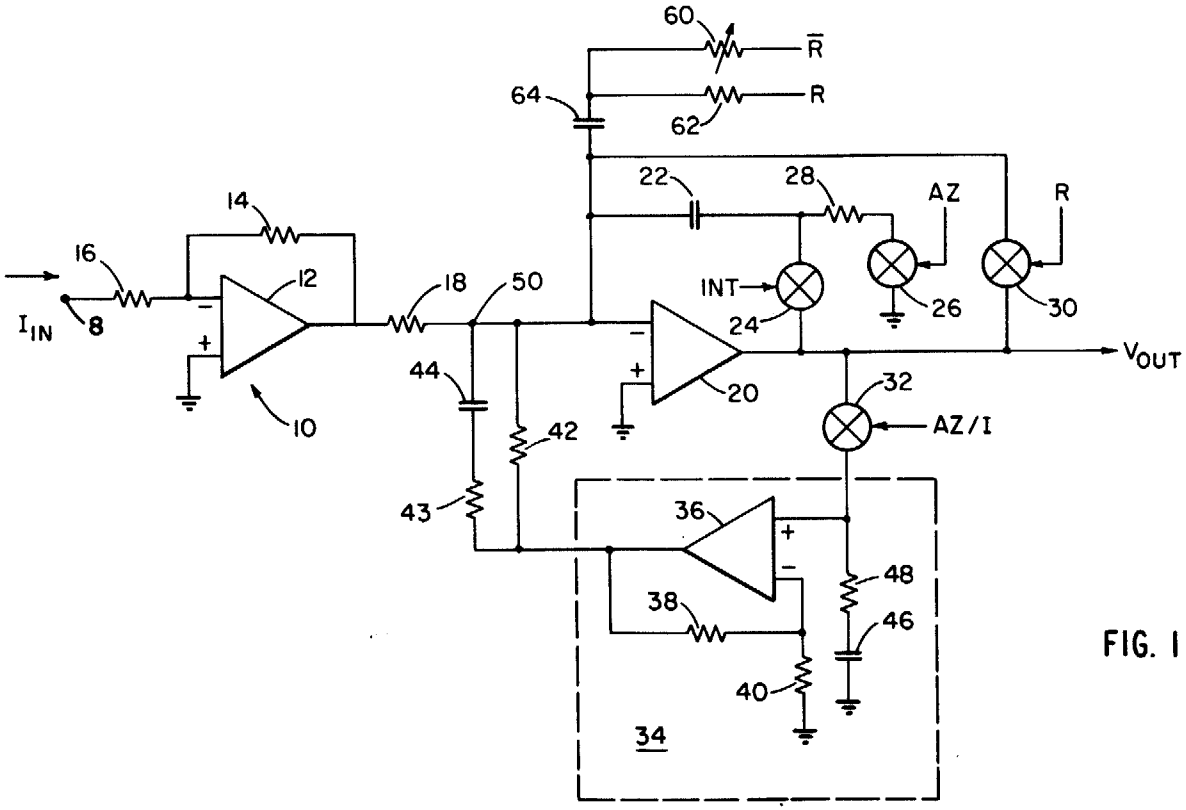
FIG. 1 shows one preferred embodiment of the present invention.

One preferred embodiment of the autozeroing integrator of the present invention is shown in FIG. 1. In this circuit, the input signal is shown as an input current $I_{in}$ which might be supplied, for example, from a photomultiplier tube or other photodetector. This input current is applied to the input of a buffer amplifier comprising a differential input operational amplifier 12, feedback resistor 14 connected from the output to the inverting input of op-amp 12, and input resistor 16. The non-inverting input of op-amp 12 is grounded to the input current return.

In response to an input current applied to input terminal 8, buffer amplifier 10 provides a voltage at its output. This voltage is applied to the autozeroing integrator circuit of the present invention. The integrating circuitry includes input resistor 18, differential amplifier 20, integrating capacitor 22, and switch 24. When the integrator circuit is in integrate mode, an INT signal controlling switch 24 is high causing switch 24 to close so that capacitor 22 is connected from the output of op-amp 20 to the inverting input of op-amp 20; and an output voltage applied to resistor 18 from buffer amplifier 10 is integrated in a conventional fashion. The remaining circuitry shown in FIG. 1 performs the reset and autozeroing functions, and the operation of this circuitry is described in detail below.

After an input signal has been integrated, the integrator may be reset so that its output is zero in preparation for the integration of a subsequent signal. During reset mode, the voltage accumulated on integrating capacitor 22 is discharged, and capacitor 22 is charged to a voltage equal to the input offset voltage of operational amplifier 20. Then switch 30 is opened to disconnect the output of op-amp 20 from its inverting input. This causes the output from op-amp 20 and the integrator to be exactly zero volts, and the integration is begun with no error in the output voltage of the integrator which would otherwise be caused by the offset voltage of op-amp 20.

Figure 2:
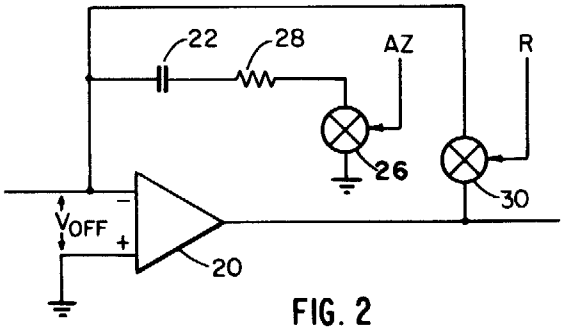
FIG. 2 shows the operation of the circuit in FIG. 1 during reset mode.

Referring to FIGS. 1 and 2, the operation during reset mode of the circuit shown in FIG. 1 will be explained. During the reset period, the INT signal to switch 24 goes low, disconnecting capacitor 22 from the output of op-amp 20. An R signal, applied to a switch 30 goes high during reset mode causing switch 30 to connect the output of op-amp 20 to the inverting input. With switches 24, 26, and 30 so connected, the integrator circuit then appears as shown in FIG. 2. Op-amp 20 has a very high gain, typically on the order of 100,000 or greater. With the output fed back to the inverting input of op-amp 20, the high gain of the op-amp forces the output voltage of op-amp 20 to equal the input offset voltage of op-amp 20. Resistor 28 limits the discharge current from capacitor 22 and is chosen so that the RC time constant of capacitor 22 and resistor 28 is very short compared to the reset period. Due to the low output impedance of op-amp 20, any voltage stored on capacitor 22 during the previous integration period is quickly discharged, and capacitor 22 charges to a voltage equal to the input offset voltage of op-amp 20.

The autozero period immediately follows the reset period. To begin the cycle, the R signal goes low causing switch 30 to open and disconnecting the output of op-amp 20 from the inverting input thereof; and an AZ/I signal goes high, causing a switch 32 to close, connecting the output of op-amp 20 to a current autozero amplifier circuit 34. Switch 26 remains closed. The configuration of the integrator circuit is then as shown in FIG. 3.

Figure 3:
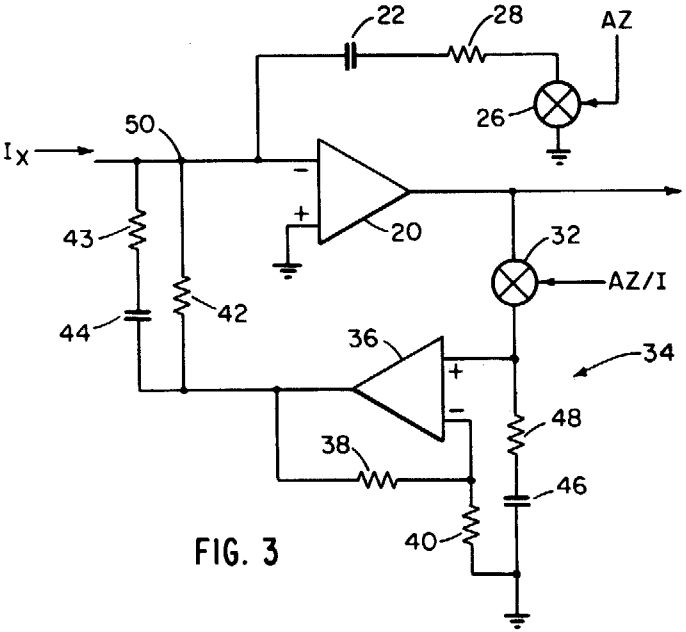
FIG. 3 shows the operation of the circuit in FIG. 1 during autozero mode.

An input current, designated as $I_x$ in FIG. 3 tends to flow into or out of the node 50 at the inverting input of op-amp 20 for the following reasons. During the autozero cycle, the input to input buffer amplifier 10 is disconnected. With no input, the voltage at the output of op-amp 12 will be equal to the input offset voltage of op-amp 12, due to the negative feedback through the resistor 14. The voltage at the input to op-amp 20 will be equal to the input offset voltage, as described. Generally, the offset voltages of op-amps 12 and 20 will not be the same; and the difference in these voltages causes a current to flow through resistor 18 into the node at the inverting input of op-amp 20. Also, an input bias current to op-amp 20 will flow out of node 50. The net current flowing into node 50 is the difference between $I_x$ and the bias current. Were this net input current not compensated for, it would be integrated and the integrator output would drift.

Figure 4:
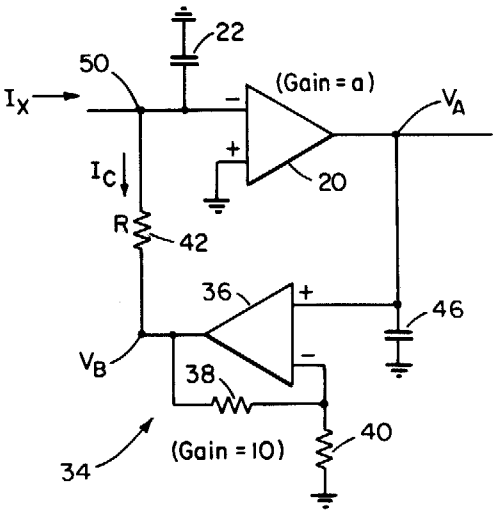
FIG. 4 is a circuit showing signals useful in explaining the operation of the circuit of FIG. 1 during autozero mode.

Referring to FIG. 4, a simplified circuit equivalent of FIG. 3 is shown which is helpful in explaining how offset current amplifier circuit 34 compensates for $I_x$ and the bias current of op-amp 20. With switch 32 closed, the output of amplifier 20 is fed back to its inverting input via amplifier 36. The gain of amplifier circuit 34 is determined by feedback resistors 38 and 40 and is typically on the order of 10. Amplifier 20, however, operates open-loop, and its gain is very large. Because of this large gain, the negative feedback around amplifier 20 causes the input voltage to stabilize at a voltage equal to the offset voltage of op-amp 20, as described below. In this quiescent condition, the compensating current $I_c$ supplied by op-amp 36 through resistor 42 to node 50 must equal the current $I_x$ from op-amp 12 minus the input bias current to op-amp 20. Thus, the current $I_c$ compensates for the net current flowing into the input node 50 to op-amp 20. The input voltage to op-amp 36 required to maintain this compensating current is stored on capacitor 46 so that the compensating current will remain constant during the integration cycle of the integrator.

Referring again to FIG. 3, a resistor 48 is in series with capacitor 46 to damp the response to autozero circuit 34 and to narrow the noise bandwidth. The transient response of the autozero circuit is principally determined by resistor 43 and capacitor 44 in parallel with resistor 42. By choosing the time constant of RC circuit 44 and 43 to be equal to the time constant of RC circuit 22 and 28, the pole introduced by RC circuit 44 and 43 is cancelled by the zero introduced by RC circuit 22 and 28.

As stated above, during the autozero period, the input to amplifier 20 will remain equal to the input offset voltage of amplifier 20 due to the negative feedback provided by amplifier 34. This can be easily verified. If the output voltages from amplifiers 20 and 36 are denoted respectively by $V_A$ and $V_B$, as shown in FIG. 4, the output voltages from these amplifiers may be expressed as follows:

$$V_A = a(V_B - I \cdot R - V_{OA}) \quad (1)$$

$$V_B = 10(V_A - V_{OB}) \quad (2)$$

where a is the open loop gain of op-amp 20, I is the current through resistor 42, R is the value of resistor 42, $V_{OA}$ and $V_{OB}$ are respectively the input offset voltages of op-amps 20 and 36, and 10 is the gain of op-amp 36 as determined by resistors 38 and 40. Combining equations (1) and (2) and collecting terms gives the following result:

$$V_B(1 - 10a) = 10a(I \cdot R + V_{OA}) - 10V_{OB} \quad (3)$$

Solving for the output voltage $V_B$ from amplifier 36, equation (3) gives:

$$V_B = \left(\frac{10a}{1 - 10a}\right)(I \cdot R + V_{OA}) - \frac{10V_{OB}}{1 - 10a} \quad (4)$$

Since the gain a of op-amp 20 is very much greater than 1, equation (4) may be simplified to the following approximation:

$$V_B = I \cdot R + V_{OA} \quad (5)$$

Thus, the output voltage from op-amp 36 will stabilize at a value equal to the offset voltage of op-amp 20 less the voltage drop access resistor 42; and the voltage at the input to op-amp 20 will be equal to the inverse of the offset voltage thereof.

Figure 5:
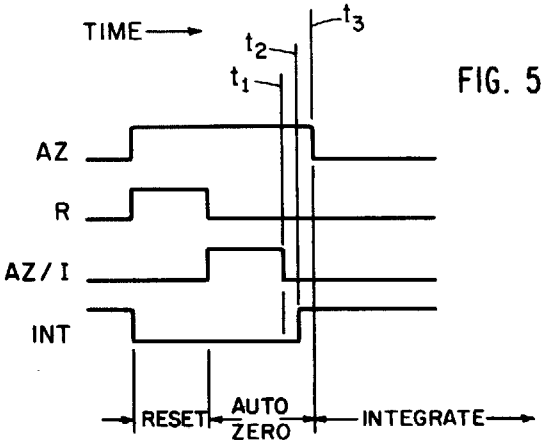
FIG. 5 shows the relationship of switching signals shown in FIGS. 1–3.

Following the completion of autozero mode, the integrator circuit returns to integrate mode. In returning to integrate mode, proper timing of the signals to switches 24, 26, 30 and 32 is important to prevent errors from being introduced into the circuit due to capacitive coupling of switching transients through these switches. The timing of these signals will be explained referring to FIG. 5 where these signals are shown. During the autozero period, switches 26 and 32 are on and switches 24 and 30 are off. To begin the transition from autozero mode to integrate mode, the AZ/I signal goes low, turning off switch 32 and disconnecting the input of autozero amplifying circuit 34 from the output of op-amp 20. This is shown at time $t_1$. Next, approximately 5 microseconds after the transition of switch 32 to the off state, switch 24 turns on. This is shown at time $t_2$. There is a low impedance path to ground from switch 24 through switch 26 and resistor 28; and any current spike resulting from turning on switch 24 will flow to ground through switch 26. Thus, the voltage stored on capacitor 22 will not be affected by any glitches produced by switch 24 as it turns on.

Next, the AZ signal goes low at time $t_3$, turning off switch 26 and placing the integrator circuit in integrate mode. Any current spike capacitively coupled into switch 26 by the transition of the AZ signal will flow into the low impedance output of op-amp 20 through switch 24 and will not affect the voltage stored on capacitor 22.

Following the previously described switching sequence, the integrator circuit is now ready to integrate an input signal. As described above, capacitive coupling from the switching signals is isolated from the integration capacitor 22, and the voltage on capacitor 22 will remain equal to the input offset voltage of op-amp 20.

Thus, the integrating circuit will begin the integration period with no offset voltage at its output.

As described above, integrating capacitor 22 is reset and the offset voltage of op-amp 20 is restored thereon during the reset period. It is not necessary to carry out the complete autozero cycle for every integration by the integrator. With a circuit such as that shown in FIG. 1 and described above, the autozero cycle need only be performed 10 to 1,000 times per second. In some applications, it is desirable to perform several consecutive integrations without having to perform a full autozero cycle between each integration. In such cases, the integrating circuit shown in FIG. 1 may be reset as explained above in connection with FIG. 2 without going through the entire autozero cycle. In such a case, the transition of the R signal from high to low may cause a small charge to be capacitively coupled through switch 30 to the input of op-amp 20, thereby causing a small voltage error upon integrating capacitor 22. To compensate for this, resistors 60 and 62 and capacitor 64 may be added. The R signal is applied through resistor 62, typically one megohm, to one terminal of a capacitor 64, typically a few picofarads. The other terminal of capacitor 64 is connected to the input of op-amp 20. The inverse of the R signal, denoted as $\overline{R}$, is coupled to the first terminal of capacitor 64 through variable resistor 60. Resistor 60 is nominally equal to resistor 62 in value. By trimming resistor 60, a charge of opposite sign may be coupled through capacitor 64 to the input of op-amp 20 to compensate for any charge capacitively coupled through switch 30 from the R signal.

One exemplary set of values for the components shown in FIG. 1 is shown below:

| | |
|---|---|
| 12 355 | 42 390KΩ |
| 14 1.6 MegΩ | 43 15K Ω |
| 16 100Ω | 44 0.001 μF |
| 18 40KΩ | 46 10 μF |
| 20 741 | 48 56Ω |
| 28 130Ω | 60 1 MegΩ |
| 36 308 | 62 1 MegΩ |
| 38 390KΩ | 64 4.7pF |
| 40 39KΩ | |

There has been described a novel integrating circuit having an autozeroing capability which provides many advantages over circuitry previously known. It should be recognized that the preferred embodiment described herein may be modified by those of ordinary skill in the art in applying the present invention to different applications. Accordingly, the present invention is to be limited only as indicated by the appended claims.

What is claimed is:

1. An autozeroing integrator, comprising:

an integrator, having an input terminal and an output terminal, for integrating during an integrating period an input signal applied to the input terminal, including:

a high-gain, differential amplifier having an offset voltage;

an integrating capacitor; and means for periodically connecting the capacitor between the output of the differential amplifier and an input of the differential amplifier during the integrating period; and means for charging the integrating capacitor to a voltage equal to the input offset voltage in the differential amplifier.

2. The integrator of claim 1 wherein the means for charging includes:

first circuit means for periodically connecting the output of the differential amplifier to an inverting input thereof; and second circuit means for charging the integrating capacitor to the voltage present at the output of the differential amplifier when the output of the amplifier is connected to the input thereof by the first circuit means.

3. The integrator of claim 2 wherein the second circuit means includes:

means for connecting a first terminal of the capacitor to an inverting input of the amplifier; and means for connecting a second terminal of the capacitor to ground.

4. The integrator of claim 1 further including:

current autozeroing means for providing a compensating current during the integrating period to one input of said differential amplifier, the compensating current being of a value so as to compensate for error currents flowing into said capacitor so that the integrator output signal is representative of the integral of the input signal without drift caused by said error currents.

5. The integrator of claim 4 wherein said error currents include a bias current flowing into an input of said differential amplifier.

6. The integrator of claim 5 further including:

a buffer amplifier having an offset voltage for providing the input signal to said integrator; and a resistor connecting the output of said buffer amplifier to the input terminal of said integrator.

7. The integrator of claim 6 wherein said error currents include input current flowing into the input terminal of said integrator due to a voltage drop across said resistor caused by a difference between the offset voltage of the integrator and the offset voltage of the buffer amplifier.

8. The integrator of claim 4 wherein said current autozeroing means includes:

a second amplifier;

second means for connecting the output of the second amplifier to the input terminal of said integrator to provide a current from the output of said second amplifier to the integrator input terminal;

means for applying a correction signal to the input of the second amplifier during an autozero period, the correction signal being of a value such that the current provided to the integrator input terminal from the output of said second amplifier cancels the error currents; and second means for storing the correction signal and for applying the stored correction signal to the input of the second amplifier after the autozero period.

9. The integrator of claim 8 wherein said means for applying includes a switch connecting the output of said integrator to an input of said second amplifier during the autozero period.

10. The integrator of claim 9 wherein said second means for connecting includes a resistor connecting the output of the second amplifier to the input terminal of the integrator.

11. The integrator of claim 9 wherein the second means for storing includes a capacitor connected to the input of the second amplifier.

* * * * *